US009370676B2

(12) United States Patent
Coulthard, Jr.

(10) Patent No.: US 9,370,676 B2
(45) Date of Patent: Jun. 21, 2016

(54) OVERHAUL LINE SYSTEM

(76) Inventor: Robert Stanley Coulthard, Jr., Panama City, FL (US)

( * ) Notice: Subject to any disclaimer, the term of this patent is extended or adjusted under 35 U.S.C. 154(b) by 904 days.

(21) Appl. No.: 13/456,324

(22) Filed: Apr. 26, 2012

(65) Prior Publication Data

US 2012/0273241 A1 Nov. 1, 2012

Related U.S. Application Data

(60) Provisional application No. 61/479,065, filed on Apr. 26, 2011.

(51) Int. Cl.
*A62C 31/05* (2006.01)

(52) U.S. Cl.
CPC ..... *A62C 31/05* (2013.01)

(58) Field of Classification Search
CPC ..... A62C 31/02; A62C 31/05; A62C 33/00; F16L 39/02
USPC ..... 169/70; 137/883, 561 A; 285/133.11, 285/133.4, 390
See application file for complete search history.

(56) References Cited

U.S. PATENT DOCUMENTS

| | | | | |
|---|---|---|---|---|
| 5,261,460 | A * | 11/1993 | Rupp | 137/883 |
| 6,102,445 | A * | 8/2000 | Thomas | 285/139.1 |
| 6,113,004 | A * | 9/2000 | Steingass et al. | 239/152 |
| 6,709,019 | B2 * | 3/2004 | Parrott et al. | 285/1 |
| 2005/0121913 | A1 * | 6/2005 | Smahl | 285/423 |

* cited by examiner

*Primary Examiner* — Len Tran
*Assistant Examiner* — Viet Le
(74) *Attorney, Agent, or Firm* — Mattingly & Malur, PC

(57) ABSTRACT

An overhaul line system includes a manifold that is attachable to, or formed integral with an attack nozzle. The manifold provides at least one quick connect coupling that allows an overhaul line to be connected to the manifold and to receive fire suppressing fluid from that manifold into a hose. The overhaul line has an elongated nozzle at its end remote from the quick connect coupling. A flow control valve is interposed between the elongated nozzle and the remote end of the overhaul line. A water treatment cartridge container can also be situated adjacent the flow control valve.

8 Claims, 8 Drawing Sheets

OVERHAUL LINE SYSTEM

CROSS REFERENCE TO RELATED APPLICATIONS

This application claims priority to U.S. provisional patent application No. 61/479,065, filed Apr. 26, 2011, the disclosure of which is expressly incorporated herein by reference.

FIELD OF THE INVENTION

The present invention is directed generally to an overhaul line system for fire fighting. More specifically, the present invention is directed to an overhaul line system that is usable in conjunction with a fire fighting attack nozzle assembly. Most particularly, the present invention is directed to an overhaul line system that provides a fire fighter with a reduced water volume discharge capability. Once a fire has been knocked down, by use of the attack nozzle, the overhaul line system can be used to discharge lesser volumes of water onto hot spots or other areas which need to be extinguished but which do not require the water volume which has to be discharged from the attack nozzle. The overhaul line system provides a controllable, reduced water volume flow capability while maintaining the capability of the attack nozzle to protect the fire fighters in case of a flashover or the possibility of finding a hidden working fire.

BACKGROUND OF THE INVENTION

When firefighters arrive on the scene of a typical fire, the first priority is to knock down the flames in order to limit the damage being done by the fire. This is accomplished in the most expeditious manner by directing a large volume of water, at a high rate of flow, directly onto the fire. This high volume, high flow of water will quickly suppress the majority of the fire by removing oxygen and by reducing temperature. Once the majority of the flames have been knocked down, which usually occurs in the first few minutes after the arrival of the firefighters on the scene, the bulk of the time is spent overhauling the fire site by putting out small stubborn fires, extinguishing smoldering debris and ensuring that the fire is completely extinguished. The attack nozzle is not specifically suited for such a task. It wastes water, damages property, exposes the firefighters to unnecessary risk of injury, destroys possible evidence of criminal activity and is generally unsatisfactory for the task.

A typical attack nozzle that is attached to a conventional fire hose can discharge 50 to 150 gallons of water per minute. In the initial stages of a firefighting operation, this high volume, high flow rate of water, or another fire suppressing liquid, is critically important. The large amount of water will usually knock down the large percentage of flames at a fire scene. However, once the flames have been so knocked down, the firefighters have little recourse but to continue to discharge 50 to 150 gallons of water per minute to put out smoldering debris and to be sure that the fire is completely out.

A prolonged, high volume use of water is unnecessary and is often more destructive than the fire itself. In the majority of fires, the bulk of the property damage is caused by water damage not by the flames themselves. In a multi-story dwelling or in a multi-unit structure, a fire in one room or in one apartment often will have fire damage that is limited to that one area. However, the discharge of large volumes of water, well after the initial fire has been controlled, and for the purpose of putting out any hot spots, results in very substantial water damage. In a number of instances, up to 80 percent of the time at a fire scene is devoted to the overhauling or extinguishing of such hot spots. It is not necessary to use a flow of 50 to 150 gallons of water per minute to put out smoldering debris. Lower rooms of a dwelling or apartments on lower floors of a building sustain substantial water damage as a result of this use of far more water than is necessary.

A fire hose that is filled with high pressure water is dangerous to the fireman who has to drag it from location to location in a room in a building and from room to room. If the attack nozzle is not held securely, it can escape from the grip of the firefighter and can become a deadly object flailing around in a room. A length of typical fire hose, filled with high pressure water, is heavy and difficult to move. A large number of injuries that are sustained by firefighters are a result of the exertion which is required to move a heavy line from place to place within a room. At the same time, it is not safe to remove the large line in favor of a replacement small line that is lighter in weight and that has reduced flow capabilities. No fire is ever safe until it is fully extinguished and cold. It is always possible that the fire will reignite in a flashover that can easily cause serious injury or death. For that reason, it is not a reasonable course of action to replace a large fire line and an attack nozzle with a smaller line. The firefighter needs the safety that can be provided, if needed, by the high volume supply of water provided by a main line and an attack nozzle.

The cause of a fire is always a concern. In the investigation of a fire site by a fire marshal or other personnel, the prolonged use of an attack nozzle, beyond the time required to knock down the initial fire, will often result in the destruction of potential evidence which could have benefited the investigator in his determination of the cause of the fire. If some type of liquid accelerant was used to start a fire, the more it is diluted by large quantities of discharged water, the more difficult it is to detect. When the fire is a result of a faulty appliance, bad wiring, a candle that was left unattended, or any other cause, the destructive force of high pressure water sprays provided by a typical attack nozzle will make the investigator's job that much more difficult. Once the initial fire has been knocked down and controlled, the continued use of the attack nozzle to control hot spots and to put out small fire sites will render the fire scene that much more difficult to investigate.

It will be readily apparent that a need exists for an alternative or an adjunct to the use of a main line and an attack nozzle in the course of a firefighting operation. The overhaul line system in accordance with the present invention provides such an alternative or adjunct and is far superior to the prior art.

SUMMARY OF THE INVENTION

It is an object of the present invention to provide an overhaul line system.

Another object of the present invention is to provide an overhaul line system that is a compliment to a main firefighting line and attack nozzle.

A further object of the present invention is to provide an overhaul line system that utilizes a portion of the water flow in the main line.

Yet another object of the present invention is to provide an overhaul line system which substantially reduces water damage.

Still a further object of the present invention is to provide an overhaul line system which is effective yet which is easy to use and which will greatly reduce firefighter injuries caused by handling large, pressurized fire hoses.

Even yet another object of the present invention is to provide an overhaul line system which will greatly reduce the damage to physical evidence that can be used to possibly determine the cause of a fire.

Still even a further object of the present invention is to quickly add an adjunct line, with reduced water flow and at reduced pressure without shutting down the main line.

The overhaul line system in accordance with the present invention provides a manifold, either as a separate component, or as a part of an attack nozzle. The manifold has at least one and possibly a plurality of quick connect couplings, each of which allows the connection of an overhaul line to the manifold. Each quick connect coupling is joined to one end of an overhaul line, which is a smaller diameter hose that has a flow capability more in the range of 5 to 10 gallons per minute. The discharge end of the overhaul line is provided with a flow control valve and with an elongated discharge nozzle. Intermediate the end of the hose and the flow control valve there may be positioned a cartridge receiving chamber. That chamber can receive a cartridge of an agent which can generate foam, or a liquid which can reduce the surface tension of the water being discharged or which can, in some other way, aid the firefighter in his task. The chamber can be replaced with a male-to-male threaded adaptor, if the use of the chamber is not required. The nozzle can be provided in varying lengths, depending on the task to be performed. In all instances, the nozzle is relatively long and thin so that it can be inserted into a pile of debris or into the interior of an area that may still be hot enough to combust.

The overhaul line system in accordance with the present invention has a water discharge capacity more in the range of 10 gallons per minute, as opposed to the 50 to 150 gallons per minute discharge range of the typical attack nozzle. Once the attack nozzle has knocked down the flames, the overhaul line can be used to extinguish any remaining hot spots and can put out embers that are still smoldering. The reduction in water flow by 90 percent or more results in substantially reduced water damage. While some collateral water damage is unavoidable, the use of 10 gallons of water per minute will greatly reduce that damage. Instead of destroying adjacent rooms or underlying apartments, the use of the overhaul line system in accordance with the present invention is more apt to save those rooms or apartments from excessive water damage so that they can be cleaned and returned to use instead of requiring them to be rebuilt.

A relatively short length of overhaul line, which may be in the range of ½ inch to 1 inch inside diameter and up to 30 feet in length, is much easier to handle than is a large fire hose with an attack nozzle. A firefighter can easily maneuver the overhaul line within a room or into adjacent rooms with much less physical stress and much less chance of rupture of the line or loss of control of the attack nozzle. The overhaul line remains attached to the attack nozzle and the reduced length of the overhaul line is kept sufficiently short that a firefighter who is manning the overhaul line will not become so distant from the attack nozzle that he cannot quickly return to the location of the attack nozzle in case of a flashover or other fire recurrence which would require the discontinued use of the overhaul line.

The reduced volume of water put out by the overhaul line system in accordance with the present invention is much less apt to destroy physical evidence that might be of assistance in determining the cause of a fire. A fire investigator needs physical evidence to make a determination as to the cause of a fire. If the force of the water discharged by the attack nozzle is great enough to destroy that evidence, or to wash it away, the investigator's job is thwarted. Instead, the overhaul line, in accordance with the present invention, will not be nearly as apt to destroy evidence or to render it unusable. If a liquid has been used as an accelerant, the relatively low volume of flow discharged by the overhaul line is much more likely to not wash away all traces of such an accelerant liquid.

At one time, booster lines were available and were stored on reels on a fire truck. These booster lines were more apt to be used as an adjunct or as a booster in combination with a main line and an attack nozzle. Such booster lines were apt to have a capability of 50 gallons per minute and had to be removed from the fire truck as a separate hose line. In contrast, the overhaul line of the present invention is not a separate line from the main line, instead it is an attachment or an adjunct to that main fire line.

If appropriate, both the main line and the overhaul line can be used by two firefighters at the same time to accomplish two separate tasks. One task is to maintain the firefighting capability. The second task is to extinguish small hot spots and smoldering debris. A firefighter manning the overhaul line will remain within the protective range of the water stream from the attack nozzle. The firefighter utilizing the overhaul line nozzle can rapidly find his way back to the main hose line by following the overhaul line.

The overhaul line system in accordance with the present invention overcomes the limitations of the prior art systems. It is a substantial advantage over such prior art arrangements.

BRIEF DESCRIPTION OF THE DRAWINGS

While the novel features of the overhaul line system in accordance with the present invention are set forth in the appended claims, a full and complete understanding of the invention may be had by referring to the detailed description of preferred embodiments, as set forth subsequently, and as depicted in the accompanying drawings, in which:

DESCRIPTION OF THE PREFERRED EMBODIMENTS

Figure 1:
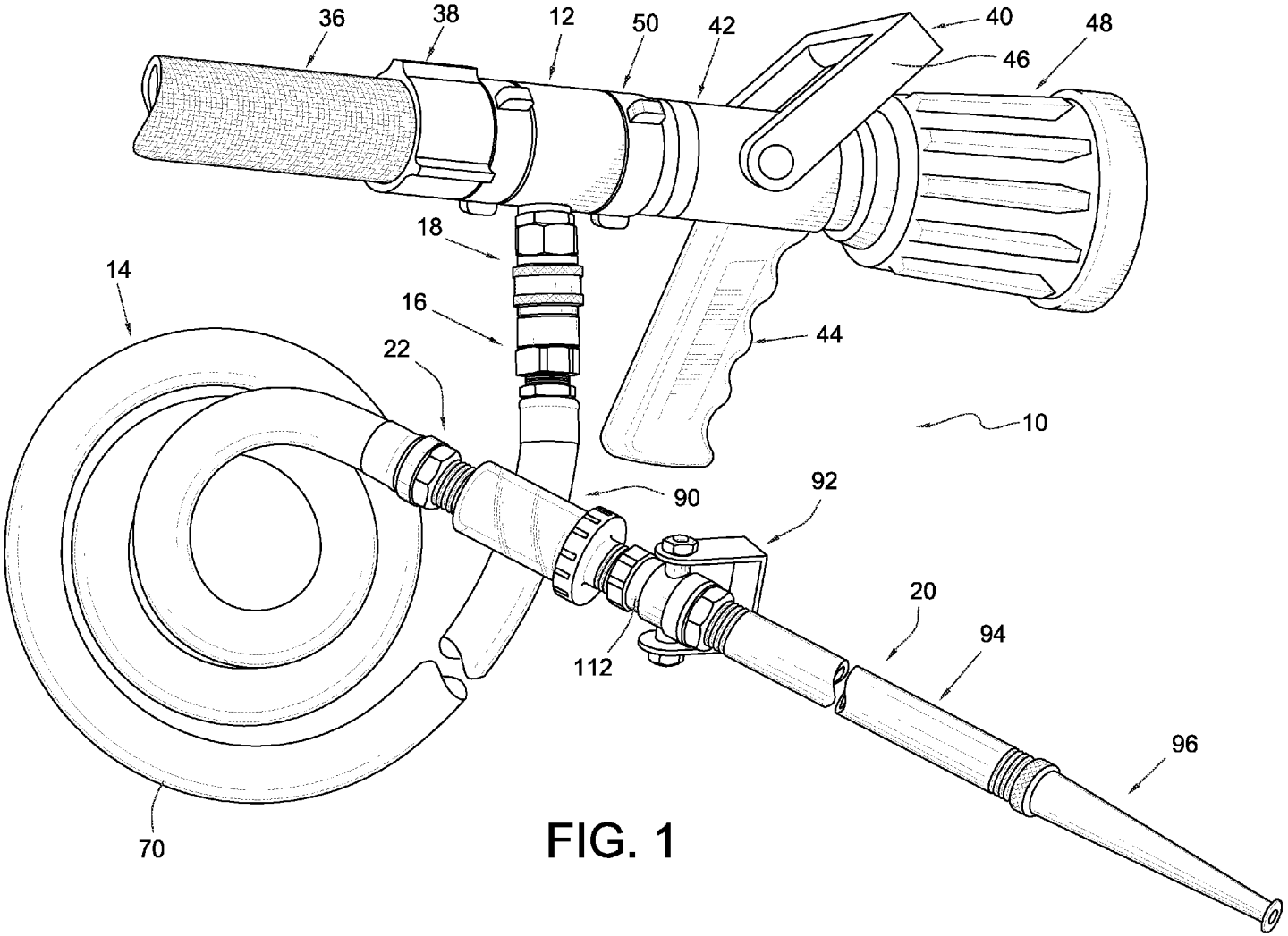
FIG. 1 is a perspective view of a first embodiment of an overhaul line system in accordance with the present invention and shown attached to a main hose line provided with an attack nozzle.

Referring initially to FIG. 1, there may be seen, generally at 10, a first preferred embodiment of an overhaul line system in accordance with the present invention. The overhaul line system, generally at 10, includes a manifold assembly 12, an overhaul line 14 which is connectable to the manifold assembly 12 at a connection end 16 through the use of a quick connect coupling, generally at 18 and a discharge assembly, generally at 20, which is attachable to a discharge end 22 of the overhaul line 14.

Figure 3:
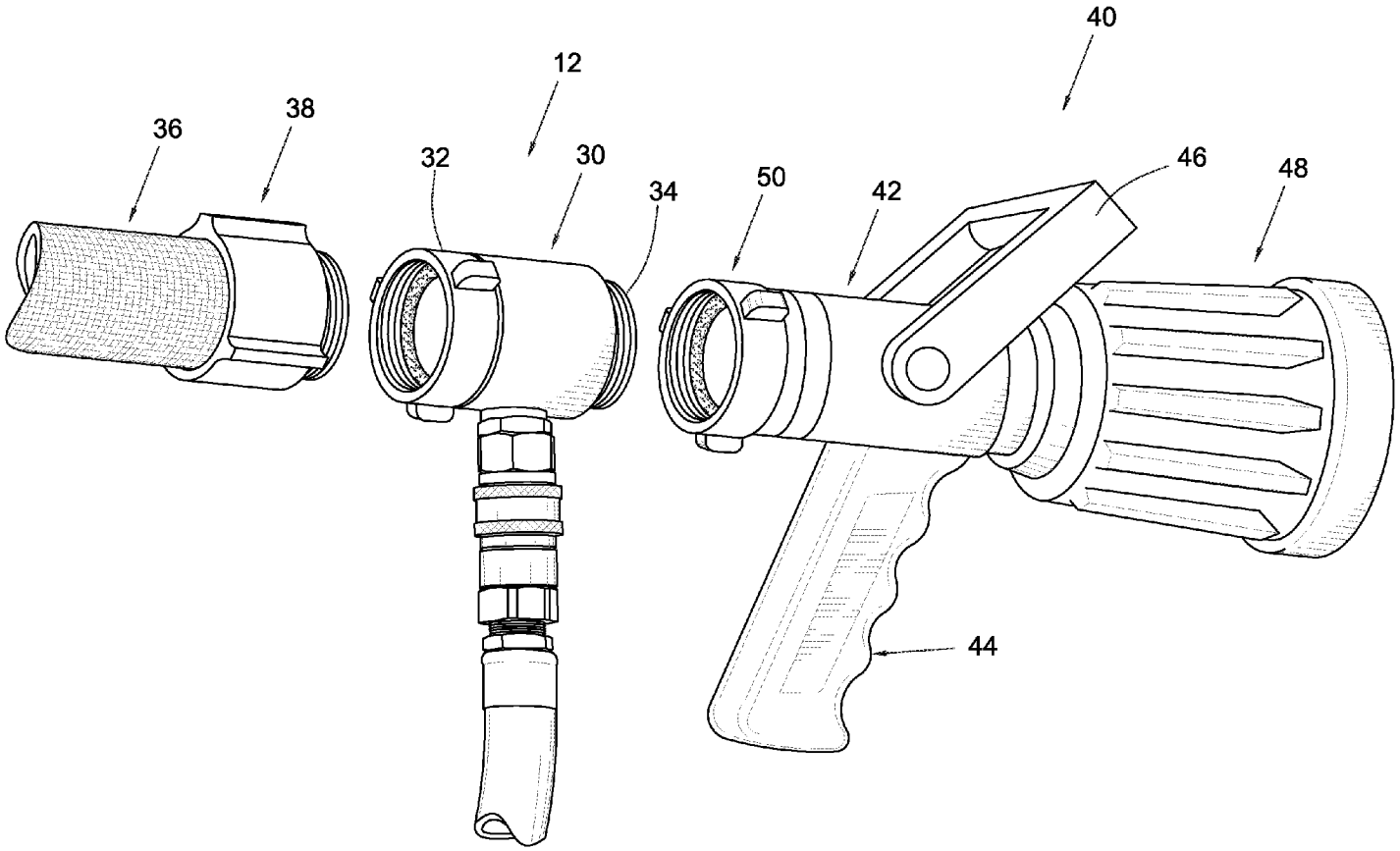
FIG. 3 is an exploded perspective of the first embodiment of the overhaul line system and showing a separable manifold interposed between the main hose line and the attack nozzle.

Turning now to FIG. 3, the manifold assembly, generally at 12, is comprised of a cylindrical manifold barrel 30 which is provided with a female threaded coupler ring 32 at an upstream end and with a male threaded nipple 34 at a downstream end. A main fire hose or line is schematically depicted at 36. It is provided with a male threaded coupler 38 whose threads are of standard size and profile and which will be receivable in the female threaded coupler ring 32 of the manifold 12.

A typical attack nozzle is depicted generally at 40. Such attack nozzles are well known in the field of firefighting and the one depicted at 40 is meant to be exemplary of the large number of types of such nozzles. The attack nozzle 40 includes an attack nozzle body 42 which is provided with a handle 44, a valve control bail 46 and a discharge nozzle end 48. An attack nozzle body female threaded coupler ring 50 is positioned at the end of the attack nozzle body 42 opposite the discharge nozzle 48. In conventional usage, the attack nozzle body coupler ring 50 would receive the male threaded hose coupler 38. In accordance with the first embodiment of the present invention, the attack nozzle body coupler ring 50 will receive the male threaded nipple 34 of the manifold assembly 12. Thus, as may be seen in both FIGS. 1 and 3, the manifold assembly of the overhaul line system 10 of the subject invention is positionable in line between the discharge end 38 of the main fire hose 36 and the attack nozzle body female threaded coupler ring 50. It will be understood that fire hoses and fire nozzles are all provided with standard thread configurations and that the manifold assembly 12 of the subject invention is provided with complementary threads. The manifold assembly 12 of the present invention of the overhaul line system 10 will thus be readily usable with fire hoses and attack nozzles used in virtually every fire department.

Figure 4:
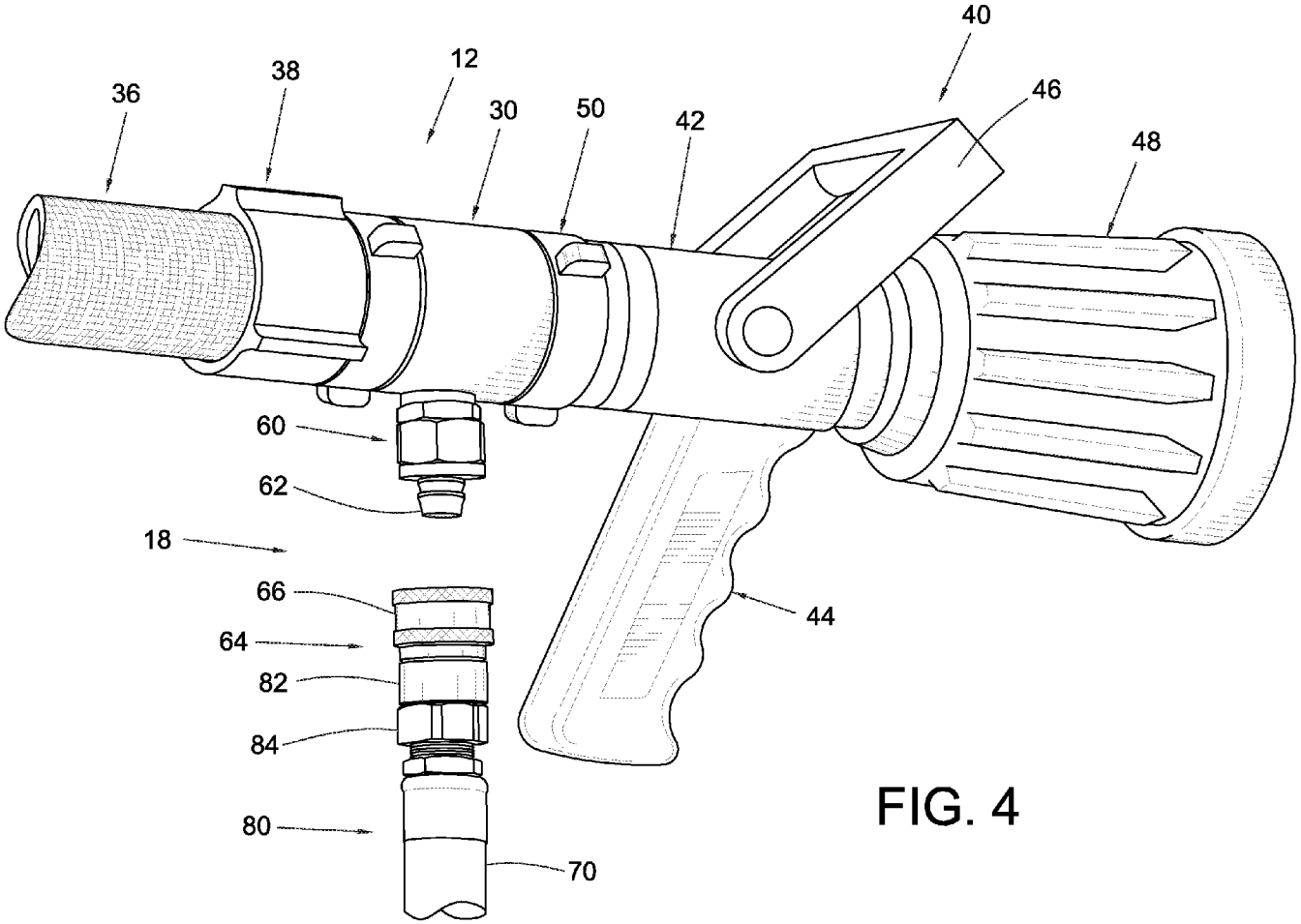
FIG. 4 is a perspective view similar to FIG. 3 and showing the manifold in line with the connection end of the overhaul line disconnected from the manifold.

As may be seen most clearly in FIGS. 1 and 4, the quick connect coupling, generally at 18, and which is usable to connect the overhaul line connection end 16 to the manifold assembly 12, has two generally conventional components. A male quick connect coupler 60 of the quick connect coupling 18 is threaded into the body 30 of the manifold assembly 12. The male quick connect coupler 60 has a reduced diameter male quick connect nipple 62 that is removably receivable in a cooperative female quick coupling socket 64. An axially slidable coupling sleeve 66 is provided on the coupling socket 64. Such quick connect couplings, generally at 18, are known in the art and are often used to couple air lines, hydraulic lines and other lines that are intended to carry fluid under pressure. Once the male nipple 62 of the quick connect coupling 18 is seated in the female socket 64, water supplied to the manifold body 30 of the manifold assembly 12 will flow into the overhaul line or hose 70. Uncoupling of the female socket 64 from the male nipple 62 is accomplished by axial movement of the coupling sleeve 64. A similar quick connect coupling could also be used to connect the discharge ends 22 of the overhaul line to the discharge assembly 20.

The overhaul line, generally at 14, is provided as a length of pressure resistant and heat resistant hose 70. It preferably has an interior diameter in the range of ½ inch to 1 inch and has a length of generally 30 feet. The inside diameter of the overhaul hose 70 is selected so that it will have a flow capability of between 5 to 10 gallons per minute. Too large a diameter will deliver too great a flow volume of water. If the length of the overhaul hose 70 is too great, several potential problems can occur. In fire situations, the visibility is very limited. A firefighter uses his hose as an umbilical cord which is connected to safety. In the case of the overhaul line, the length of the overhaul hose 70 should not be so great that the firefighter manning that overhaul line cannot rapidly return to the safety shield provided by the main line 36 and the main attack nozzle 40. In addition, too great a length of the overhaul hose 70 increases the risk that the overhaul hose 70 will become caught or tangled. This will reduce its effectiveness and may make it more difficult for the firefighter using it to return to the relative safety of the attack nozzle 40.

A coupling end 80 of the overhaul hose 70 is, as seen in FIGS. 1, 3 and 4, attached to the female quick connect coupling socket 64 by any suitable connection. The female socket 64 may be provided with a male threaded end 82 that is receivable into a female threaded coupling sleeve 84 on the coupling end 80 of the overhaul hose 70. Any other suitable connection is also usable. The female quick connect coupling socket 64 could be permanently attached to the coupling end 80 of the overhaul hose 70. The essential requirement is that the coupling end 80 of the overhaul hose 70 is easily and quickly coupled to, and disconnected from the manifold assembly 30.

Figure 5:
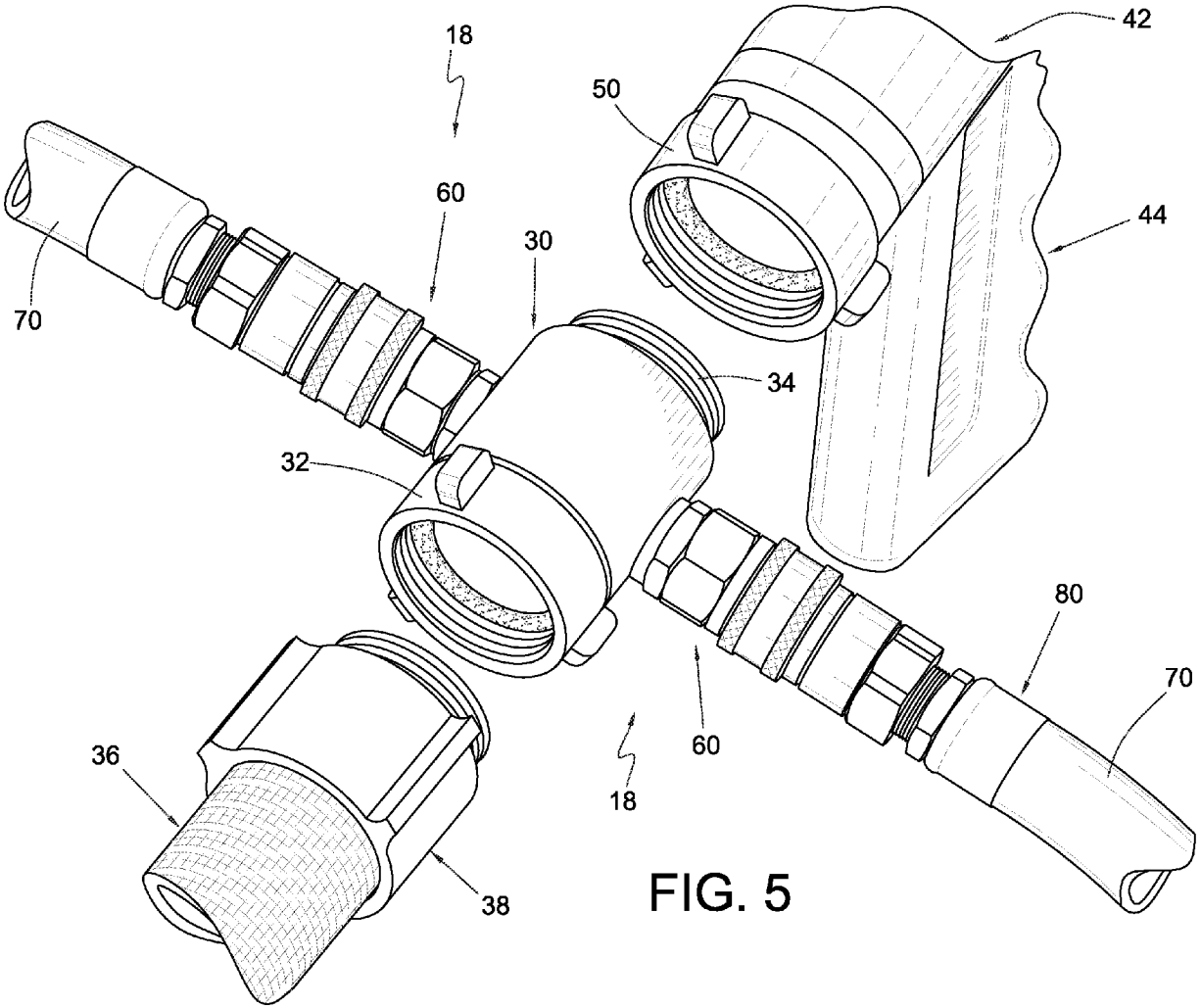
FIG. 5 is a plan view of the manifold of the overhaul line and showing two overhaul lines connected to the manifold.

In FIG. 5, there is depicted a second preferred embodiment of the manifold assembly 12 in accordance with the present invention. In the second embodiment, there are provided two quick connect couplings, each at 18. As is depicted in FIG. 5, these two quick connect couplings 18 are located generally 180° opposite from each other on the manifold barrel 30. Each such quick connect coupling 18 is usable to receive an overhaul hose 70 so that two separate overhaul lines can be manned by two separate firefighters. The two quick connect couplings 18 are preferably located generally 180° from each other so that, if the main fire hose 36 and attack nozzle 40 are laid down, the possibly two overhaul hoses 70 attached to the manifold body 30 will not be crimped or bent.

Figure 2:
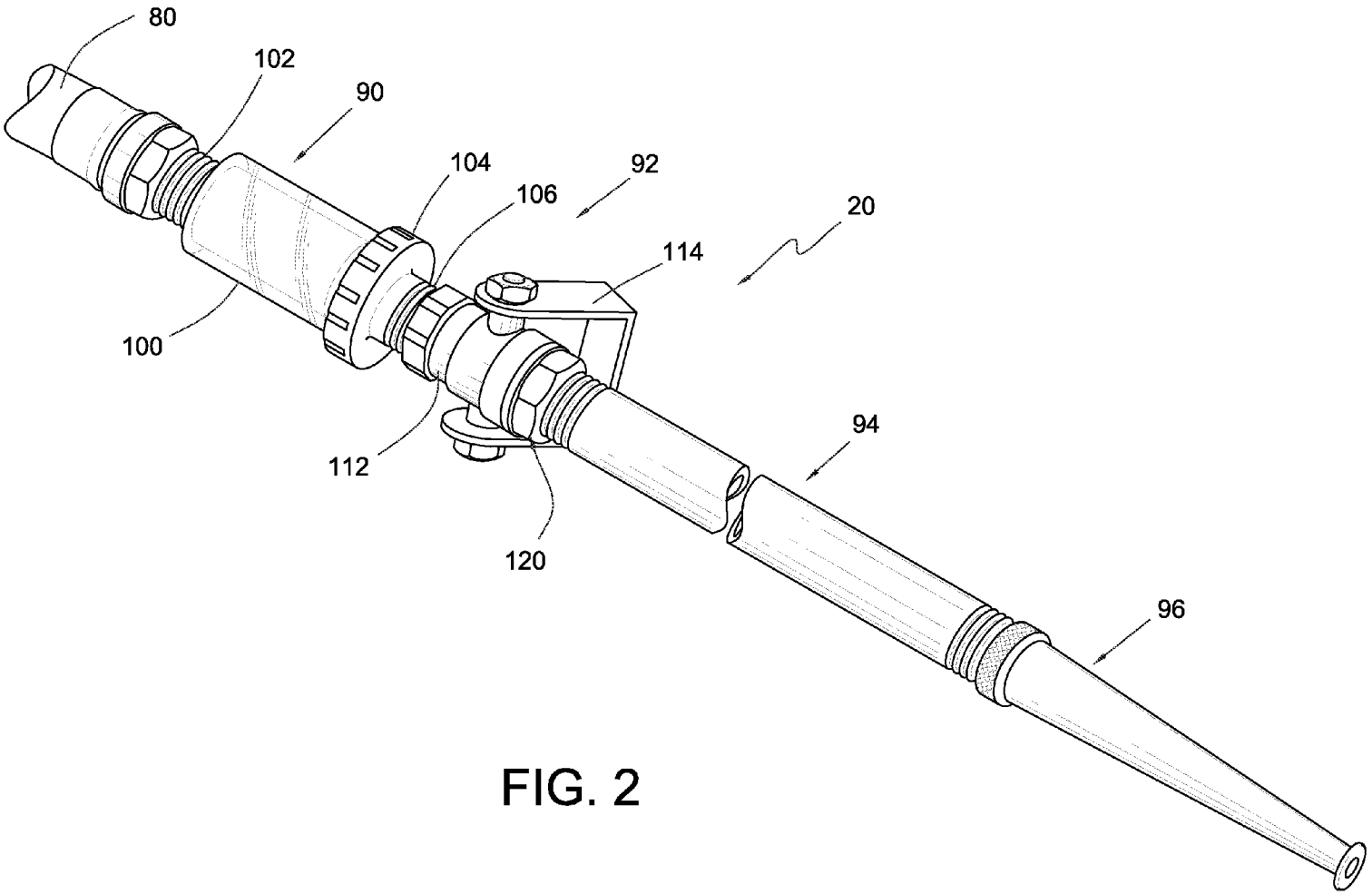
FIG. 2 is a perspective view of a first embodiment of the discharge end of the overhaul line and showing a nozzle assembly control valve and cartridge container.
Figure 6:
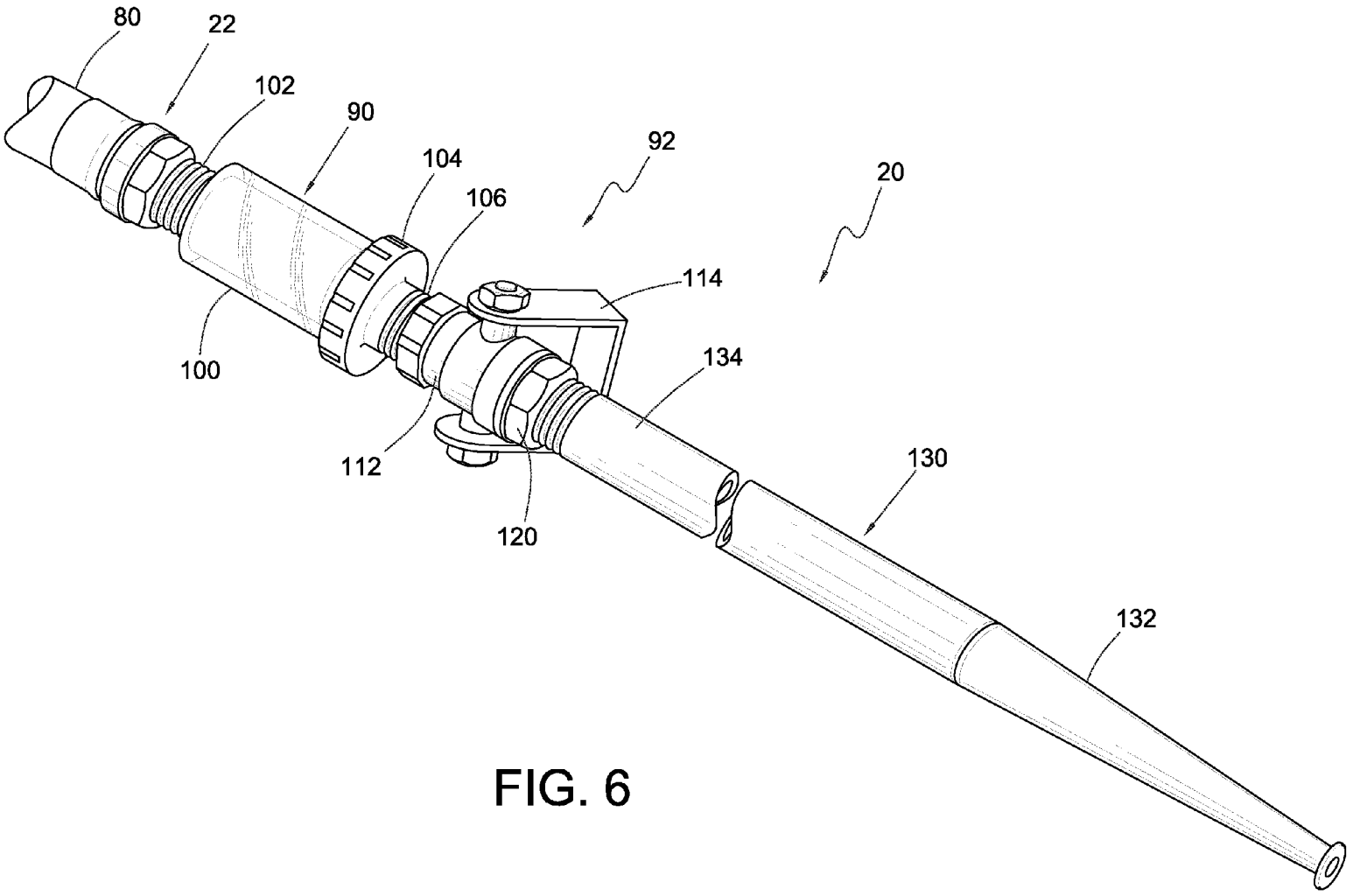
FIG. 6 is a perspective view of a second embodiment of the discharge end of the overhaul line.

A first embodiment of the discharge assembly, generally at 20, of the overhaul line system is depicted in FIGS. 1 and 2. In this first embodiment, the discharge assembly 20 includes a cartridge container 90, a discharge control valve assembly 92, a variable length discharge pipe 94 and a tapering discharge nozzle 96. The cartridge container, generally at 90, is intended to be exemplary of various cartridge containers that can be employed in the overhaul line system of the present invention. As depicted in FIGS. 1 and 6, the cartridge container 90 has a cartridge receiving chamber 100 that has an inflow male threaded nipple 102 that is configured to be connectable to the discharge end 22 of the overhaul hose 70. A removable container cover 104 is positionable at the outflow end of the cartridge receiving container 100. Any suitable connection between the cover 104 and the container 100 is usable. The discharge end of the cover 104 has a male threaded spud or nipple 106.

In use, the cartridge container 90 can receive a cartridge, which is not specifically shown, and which will dissolve as water flows through the container 90. The cartridge may contain a chemical surfactant that will reduce the surface tension of the water and will thereby make the water "wetter". Other cartridges that may be of assistance to the firefighter, can be placed in the cartridge container 90. If the cartridge container 90 is not needed, it can be replaced by a double male threaded connector, such as the one depicted at 110 in FIG. 7. Again, the specific structure of this double male threaded connector 110 is not important. It takes the place of the cartridge container 90 depicted in FIGS. 1, 2 and 6. It would be possible to eliminate the double male threaded connector 110 and to have the discharge control valve assembly 92 connectable directly to the discharge end 22 of the overhaul hose 70.

Referring again to FIGS. 1, 2 and 6, the discharge control valve assembly, generally at 92, includes a discharge control valve body 112 that encompasses a discharge control valve which is not specifically depicted. The discharge control valve will typically be a ball valve that is movable between closed and fully opened positions by the actuation of a discharge valve bail 114. The discharge valve bail 114 is generally similar in shape and operation to the valve control bail 46 that is associated with the attack nozzle 40. Such valve bails are well known to firefighters and their operation is universally understood.

The length of the discharge nozzle 96 or of the discharge pipe 94 can be varied. FIG. 2 depicts a variable length discharge pipe 94 that is interposed between a discharge end 120 of the discharge control valve assembly 92 and the discharge nozzle 96. The overall length of the discharge assembly 20 can be varied by proper selection of a discharge pipe 94 of a suitable length. In a preferred configuration, the overall length of the discharge assembly 20 can be varied from 12 inches to 36 inches, in increments of 6 inches, by the selection of a section of pipe 94 of the desired length. Depending on the conditions in which the overhaul line is apt to be used, the length of the discharge assembly can be quickly adjusted.

Figure 7:
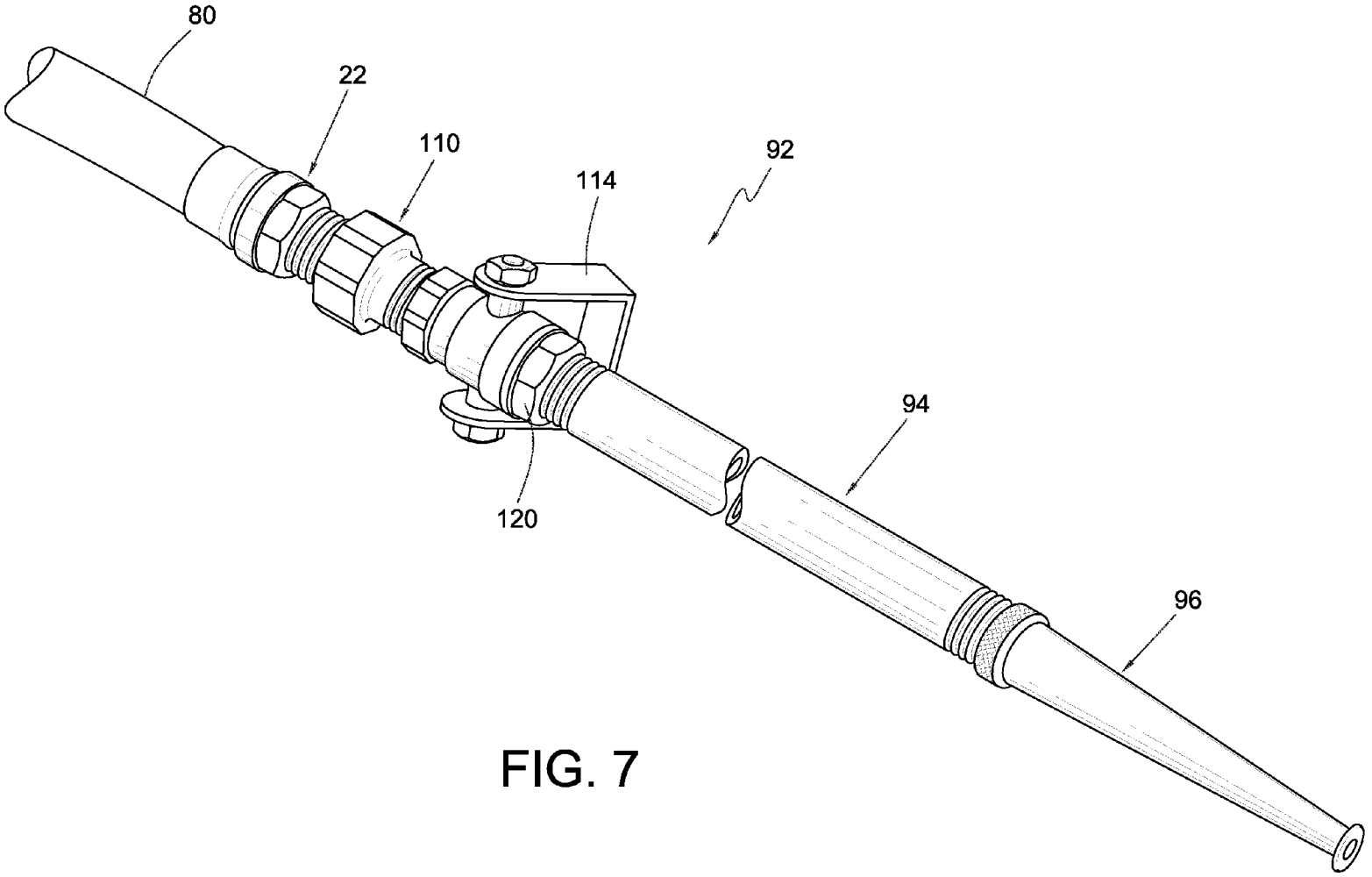
FIG. 7 is a perspective view of a third embodiment of the discharge end of the overhaul line.

In the first embodiment of the discharge assembly 20 depicted in FIG. 1, the discharge nozzle 96 is shown as a separate element which is connectable to the discharge end of the variable length discharge pipe 94. This same first embodiment is also depicted in FIG. 7 in which depiction, the cartridge container 90 has been replaced by the double male threaded connection 110. In a second embodiment of the discharge assembly 20, as seen in FIG. 6, a one-piece discharge nozzle 130 is provided. This one piece discharge nozzle 130 includes a tapered discharge nozzle body 132 and a uniform diameter discharge nozzle connector 134. As was the case in the first embodiment of the discharge assembly 20, in the second embodiment, the length of the one piece discharge nozzle 130 can be selected in anticipation of the purpose for which the overhaul line is to be used. If, for example, the fire is in a barn filled with bales of hay, it would be appropriate to select a discharge nozzle assembly 20 that would have sufficient length to reach the interior of the bales of hay. If such a lengthy discharge assembly 20 were not needed, the length of the discharge nozzle 130 or the length of the discharge pipe 94 could be shortened. Multiple lengths of nozzles 130 and/or pipes 94 could easily be carried by a fire truck to provide the proper selection for the situation encountered at the fire scene.

Figure 8:
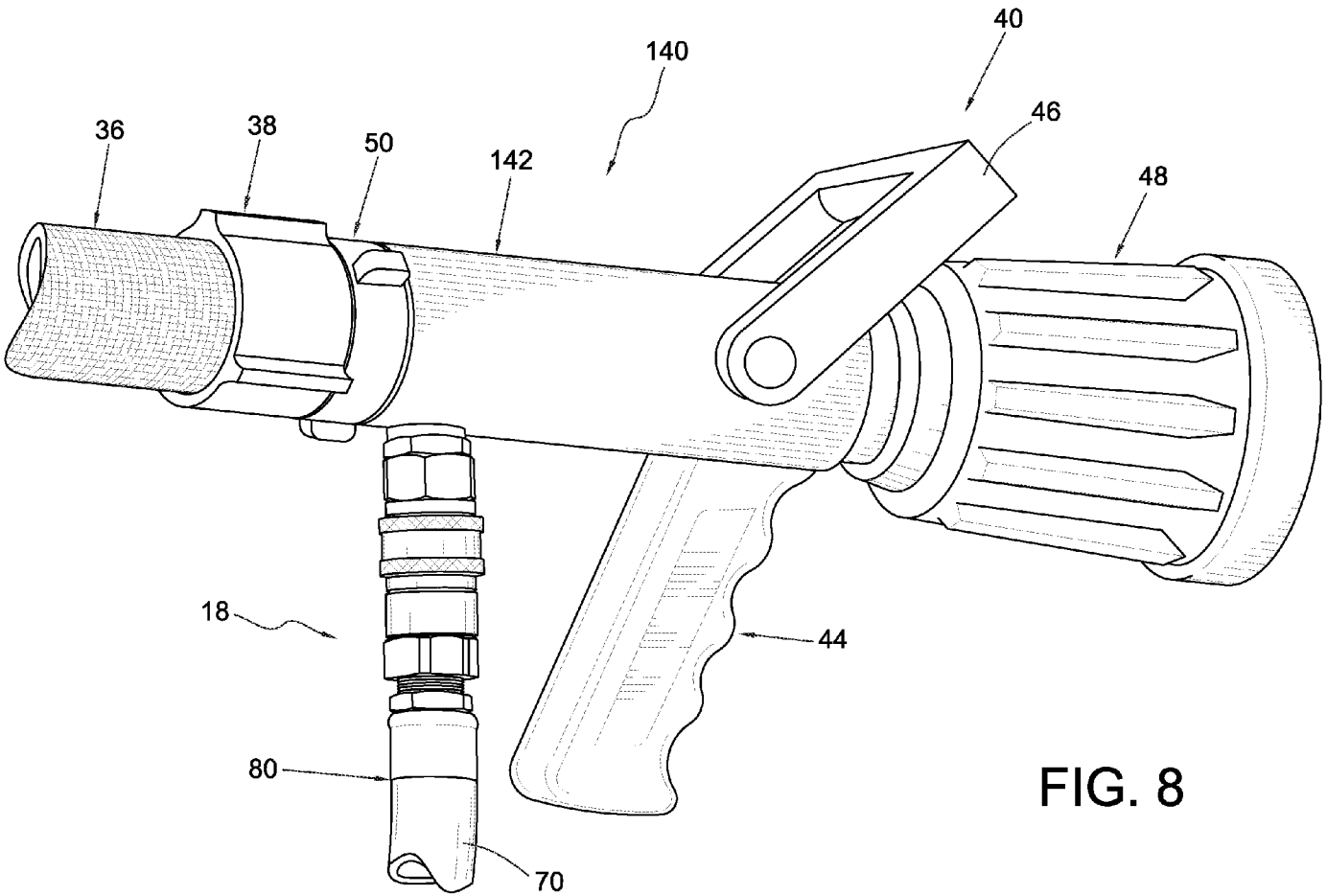
FIG. 8 is a perspective view of a second preferred embodiment of the overhaul line system of the present invention in which the manifold is integral with the attack nozzle.

A second preferred embodiment of an overhaul line system in accordance with the present invention is depicted at 140 in FIG. 8. In this second embodiment, in which like reference numerals are used to identify elements that are the same in both embodiments, the attack nozzle body 42 of the main attack nozzle 40 includes a manifold assembly, which was a separate element 12 in the first preferred embodiment depicted in FIG. 1. In the second preferred embodiment 140, there is no separate manifold assembly 12. Instead, the main attack valve body 42 includes a manifold portion 142. That manifold portion 142 includes the one or more quick connect couplings 18, which are the same in structure and function as their counterparts in the first preferred embodiment. In the second preferred embodiment, the manifold body 142 and the main attack valve body 42 are configured as one element. This has benefits from a standpoint of length of assembly time and assures that the overhaul line hose connection will always be available.

In use, once the main flame front of the fire has been suppressed, a call can be made for an overhaul line to be brought in. The overhaul line will have been previously assembled with the desired length of discharge assembly 20 and with a cartridge of a suitable material placed in the chamber of the cartridge container, if desired. Once the overhaul line has been brought in, it can be quickly connected to one of the quick connect couplings of the manifold. Water will then flow through the overhaul line 70 to the discharge nozzle 96 or 132 where the flow rate can be controlled by the discharge control valve assembly 92. When all hot spots and smoldering embers have been fully put out, the overhaul line can be removed.

While preferred embodiments of an overhaul line system in accordance with the present invention have been set forth fully and complete hereinabove, it will be understood by one of ordinary skill in the art that various changes in, for example, the specific structure of the attack nozzle, the types of quick connect couplings used, the structure of the discharge control valve and nozzle and the like could be made without departing from the true spirit and scope of the present invention which is accordingly to be limited only by the appended claims.

What is claimed is:

1. An overhaul line system comprising:

a main fire hose with a discharge end and having a male threaded coupler at the discharge end;

an attack nozzle having an attack nozzle body with an inlet end and including an attack nozzle body female threaded coupler ring at the inlet end of the attack nozzle body, and with an attack nozzle discharge end with a discharge nozzle at the attack nozzle discharge end;

a manifold assembly positioned directly in line between the discharge end of the main fire hose and the inlet end of the attack nozzle body, the manifold assembly having a manifold body with a manifold inlet to receive a high volume, high flow rate main liquid flow from the discharge end of the main fire hose and having a manifold main outlet to pass that main liquid flow directly to the inlet end of the attack nozzle body, which attack nozzle body is positioned directly at the manifold main outlet of the manifold assembly;

a manifold assembly female coupler ring at the manifold inlet and in engagement with the main fire hose discharge end male threaded coupler;

a manifold assembly male threaded nipple at the manifold main outlet and in engagement with the attack nozzle body female threaded coupler ring:

a manifold quick connect coupling assembly on the manifold body, intermediate the manifold inlet and the manifold main outlet, the manifold quick connect coupling assembly including a first quick connect coupler;

an overhaul hose having a manifold assembly connection end and a discharge end, the overhaul hose being releasably connected to the manifold body to direct a reduced volume, low flow rate secondary liquid flow, taken from the main liquid flow passing through the manifold assembly, to the overhaul hose when the overhaul hose is connected to the manifold assembly;

a releasable quick connect coupling on the manifold assembly connection end of the overhaul hose, the releasable quick connect coupling including a second quick connect coupler in engagement with the first quick connect coupler to couple the overhaul hose to the manifold quick connect coupling assembly to pass the reduced volume, low flow rate secondary liquid flow from the first quick connect coupler, through the second quick connect coupler and to the discharge end of the overhaul hose from the manifold quick connect coupling assembly only when the first and second quick connect couplers are coupled to each other and to prevent the passage of the reduced volume, low flow rate secondary liquid flow from the first quick connect coupler when the first and second quick connect couplers are disengaged from each other, the main liquid flow from the manifold inlet continuing to pass directly to the attack nozzle from the manifold main outlet when the first and second quick connect couplers are engaged with each other and when they are disengaged from each other; and a discharge assembly at the discharge end of the overhaul hose, the discharge assembly receiving the reduced volume, low flow rate secondary liquid flow from the manifold quick connect coupling assembly only when the second quick connect coupler on the overhaul hose is coupled to the first quick connect coupler on the manifold body, the discharge assembly including a discharge nozzle to receive the secondary liquid flow from the manifold quick connect coupling assembly through the overhaul hose, and a discharge control valve assembly at an inlet to the discharge nozzle, the discharge control valve assembly being usable to control an amount of the secondary liquid flow discharged from the discharge nozzle when the first and second quick connect couplers are engaged to thereby allow the secondary liquid flow to exit from the manifold quick connect coupling assembly, to pass through the manifold assembly connection end of the overhaul hose and to discharge through the discharge assembly and to the discharge end of the overhaul hose.

2. The overhaul line system of claim 1 wherein the manifold quick connect coupling assembly includes one of a male nipple and a female socket.

3. The overhaul line system of claim 1 wherein the discharge assembly includes a cartridge container usable to receive a dissolvable cartridge.

4. The overhaul line system of claim 3 wherein the cartridge container includes a removable cover and is in line with the discharge assembly.

5. The overhaul line system of claim 1 wherein a length of the discharge nozzle is variable.

6. The overhaul line system of claim 1 further including a variable length discharge pipe positioned between the discharge nozzle and the discharge control valve assembly.

7. The overhaul line system of claim 1 wherein the overhaul hose has an interior diameter between ½ inch and 1 inch.

8. The overhaul line system of claim 1 further including a double male threaded coupling intermediate the overhaul hose discharge end and the discharge control valve assembly.

* * * * *